United States Patent [19]

Knelson

[11] Patent Number: 4,846,781

[45] Date of Patent: Jul. 11, 1989

[54] CENTRIFUGAL SEPARATOR

[76] Inventor: Benjamin V. Knelson, 20313-8th Ave. R.R #11, Langley, British Columbia, Canada, V3A 6Y3

[21] Appl. No.: 205,743

[22] Filed: Jun. 13, 1988

[51] Int. Cl.[4] ..... B04B 11/00

[52] U.S. Cl. ..... 494/27; 494/43; 494/60

[58] Field of Search ..... 494/27, 28, 29, 30, 494/60, 85, 43, 45; 210/781, 782

[56] References Cited

U.S. PATENT DOCUMENTS

| | | | |
|---|---|---|---|
| 1,594,501 | 8/1926 | Eccleston | 494/29 |
| 4,170,420 | 10/1979 | Underwood | 366/165 |
| 4,361,480 | 11/1982 | Corbus | 494/80 |
| 4,608,040 | 8/1986 | Knelson | 494/27 |

FOREIGN PATENT DOCUMENTS

| | | |
|---|---|---|
| 1748734 | 5/1934 | Australia . |
| 2205535 | 2/1935 | Australia . |
| 1111809 | 11/1981 | Canada . |

*Primary Examiner*—Robert W. Jenkins

*Attorney, Agent, or Firm*—Adrian D. Battison; Stanley G. Ade; Murray E. Thrift

[57] ABSTRACT

A centrifugal separator for gold or the like is of the type in which a bowl is rotated at high speed so that materials fed into the bowl pass over the peripheral wall of the bowl to an open mouth. On the inner surface of the bowl is provided a series of ribs defining peripheral recesses in which the heavy material is collected. An outer shell surrounds the bowl and defines with it a chamber into which water is injected to pass through openings at the base of the recesses to fluidize the material within the recesses. The outer shell has a peripheral wall of increasing diamter toward the open mouth with a plurality of openings being provided in the shell around to open mouth to allow the escape of silt collecting in the chamber. A wear resistant plastics material is attached to the bowl at the open mouth and to a casing surrounding the open mouth to redirect the exiting materials to an outlet duct. A plug for the base of the bowl can be latched into place by a pivotal latch member actuated by centrifugal force caused by rotation of the bowl to prevent loss of the plug under the high forces generated during the rotation.

12 Claims, 3 Drawing Sheets

CENTRIFUGAL SEPARATOR

BACKGROUND OF THE INVENTION

This invention relates to a centrifugal separator of the type which can be used to extract heavy metals such as gold from a slurry containing the metal mixed with other materials.

My issued U.S. Pat. No. 4,608,040 and disclose a device of this type which comprises a centrifuge bowl having a base and a peripheral wall surrounding an axis passing through the base and generally upstanding from the base to an open mouth, a plurality of axially spaced inwardly projecting rings mounted on an inner surface of the peripheral wall and a plurality of openings extending through the peripheral wall from the outer surface to the inner surface thereof, the openings being arranged between each ring and the next adjacent ring and in spaced relation around the peripheral wall, means mounting the bowl for rotation about the axis, means for feeding the materials into the bowl so that during rotation of the bowl they flow over the peripheral wall for discharge from the open mouth and means for applying fluid to the outer surface of the bowl so as to pass through the openings and fluidize the materials between the rings.

This device has been found to operate very satisfactorily and in a considerably improved manner relative to prior art devices Such prior art devices are shown for example in my Canadian Patent No. 111809 and in old Australian Patents 22055/35 and 17487/34 (MacNicol).

However there remains opportunity for further improvement in operational reliability of the device and in construction of the device which enables improved wear characteristics.

The present invention provides a number of improvements over my above described device which can improve wear resistance and operational reliability.

In one particular problem, the restriction to flow of the outer fluid through the holes into the bowl can cause solids in the form of silt to collect in the area surrounding the bowl, eventually leading to a loss of the required fluid flow.

According to a first aspect of the invention, therefore, there is provided apparatus for centrifugally separating intermixed materials of different specific gravities comprising a centrifuge bowl having a base and a peripheral wall surrounding an axis passing through the base and generally upstanding from the base to an open mouth, axially spaced inwardly projecting peripherally extending members defined on an inner surface of the peripheral wall so as to provide a peripherally extending recess between each member and the next adjacent member, and a plurality of openings extending through the peripheral wall from an outer surface to the inner surface thereof, the openings being arranged in the recess between each member and the next adjacent member and in spaced relation around the peripheral wall, means mounting the bowl for rotation about the axis, means for feeding materials into the bowl such that during rotation of the bowl they flow over the peripheral wall for discharge from the open mouth, ah outer bowl member surrounding the outer surface of the bowl, means for supplying fluid under pressure between the outer surface of the bowl and the outer bowl member so as to pass through the openings and fluidize the materials in the recesses, said outer bowl member comprising a sleeve member coaxially surrounding said peripheral wall, an outer bowl base and annular cover portion between said sleeve member and said bowl adjacent said open mouth said sleeve member being tapered to define a diameter thereof which increases from one and of the sleeve member adjacent the base to an opposed end of the sleeve member adjacent the open mouth of the bowl, and means defining a plurality of openings in said outer bowl member adjacent said opposed end of the sleeve member to allow escape of solid materials in said fluid.

In a further particular problem, the bowl can include a duct through the base through which the collected material is discharged after rotation of the bowl is halted. This duct is normally plugged during rotation However the plug in many cases can become disengaged during processing thus causing the fed materials to be ejected from the machine into an area reserved for collected concentrate. It is one object of the invention to provide an improved plugging arrangement for the bowl to avoid ejection of the plug.

According to a second aspect of the invention there is provided apparatus for centrifugally separating intermixed materials of different specific gravities comprising a centrifuge bowl having a base and a peripheral wall surrounding an axis passing through the base and generally upstanding from the base to an open mouth, axially spaced inwardly projecting peripherally extending members defined on an inner surface of the peripheral wall so as to provide a peripherally extending recess between each member and the next adjacent member, and a plurality of openings extending through the peripheral wall from an outer surface to the inner surface thereof, the openings being arranged in the recess between each member and the next adjacent member and in spaced relation around the peripheral wall, means mounting the bowl for rotation about the axis, means for feeding materials into the bowl such that during rotation of the bowl they flow over the peripheral wall for discharge from the open mouth, means for applying fluid to the outer surface of the bowl so as to pass through the openings and fluidize the materials in the recesses, a discharge duct mounted in said bowl through the base thereof, a removable plug member for closing the duct during rotation of the bowl, and latch means movable from a release position in which the plug member can be removed to a latching position for latching the plug member in a position thereof closing said duct, the latch means being movable to said latching position in response to centrifugal force generated by rotation of the bowl.

In a further problem, the high velocity and abrasiveness of liquid materials ejected from the bowl will cause rapid wear of the metal guide surfaces surrounding the bowl. While the above patents have proposed urethane liners to be attached to the metal surfaces the attachment techniques have not yet been satisfactory. It is one object of the invention therefore to provide an improved liner arrangement for the metal guide surfaces surrounding the bowl.

According to a third aspect of the invention there is provided apparatus for centrifugally separating intermixed materials of different specific gravities comprising a centrifuge bowl having a base and a peripheral wall surrounding an axis passing through the base and generally upstanding from the base to an open mouth, axially spaced inwardly projecting peripherally extending members defined on an inner surface of the peripheral wall so as to provide a peripherally extending recess between each member and the next adjacent member, means mounting the bowl for rotation about the axis, means for feeding materials into the bowl such that during rotation of the bowl they flow over the peripheral wall for discharge from the open mouth, a housing surrounding the open mouth for collecting and confining the material discharged therefrom, said housing defining an annular channel having an upper wall facing said open mouth and a peripheral wall surrounding said bowl which directs the material to an outlet duct and a wear resistant liner arrangement for said channel formed from a wear resistant plastics material, said liner arrangement including a cast annular ring attached to said upper wall at said peripheral wall and a cast cylindrical sleeve attached to an inner surface of said peripheral wall at said upper wall.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DETAILED DESCRIPTION

Figure 1:
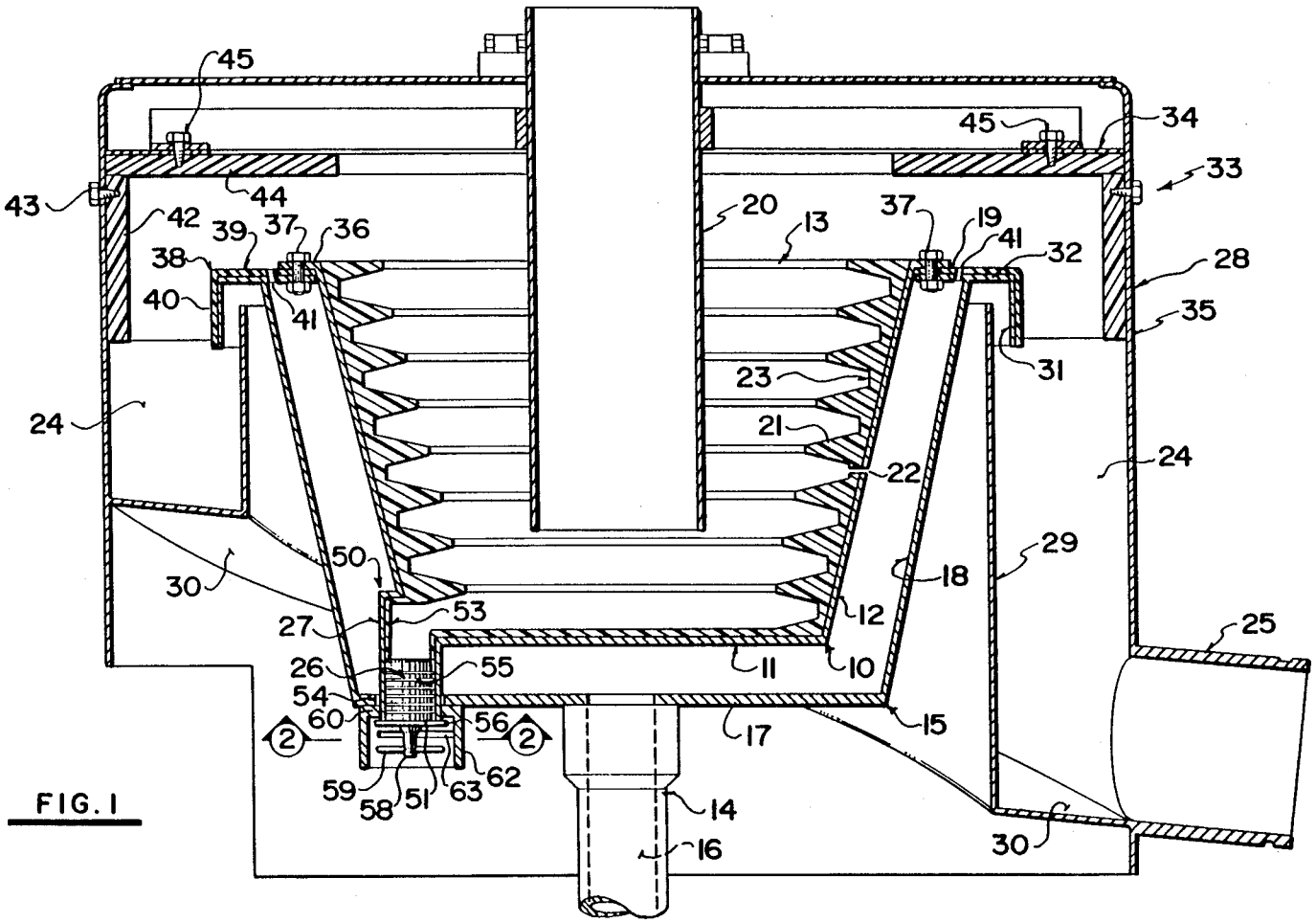
FIG. 1 is a vertical cross sectional view of a bowl and outer casing of a separation device according to the invention.

Turning firstly to FIG. 1, the basic construction of this arrangement is described in detail in my U.S. Pat. No. 4,608,040 issued Aug. 26, 1986 to which reference should be made for any detail of the device omitted from this description. For convenience of the reader some of the important features will be described here.

Thus the apparatus comprises generally a bowl 10 which has a base 11, a peripheral wall 12 and an open upper mouth 13. The bowl is mounted on a shaft 14 for rotation about its axis and is surrounded by an outer casing 15 defining a jacket or enclosure around the bowl to which liquid may be supplied by a duct 16 through the shaft 14. The jacket includes a base 17, a peripheral wall 18 and a cover portion 19.

Feed material can be deposited into the bowl through a supply duct 20 depending downwardly through the open mouth. On the inner surface of the peripheral wall of the bowl is provided a plurality of inwardly projecting rings 21 which define annular channels or recesses between the rings in which a fluidized bed is defined by a plurality of fluid inlet openings 22 which allow material to enter from the jacket 15 into the bowl through the base 23 of each of the channels. This defines a fluidized bed within the channels between the rings 21 which acts to separate heavier material which collects in the channels from lighter material which tends to flow out over the mouth of the bowl with the fluid into an outlet duct 24, 25.

After completion of a batch of the material, a plug 26 can be pulled at the bottom of the bowl from a duct 27 and the material collected in the channels washed from the bowl for collection for final separation of the required heavy metal.

The bowl 10 is mounted in a housing 28 which defines an outer surface for the channel 24. An inner circumferential wall 29 inside the housing 28 so as to form the channel 24 as an annular channel surrounding the bowl.

To assist in communication of the discharge material from the mouth of the bowl to the discharge duct 24, an inclined surface 30 is arranged around the bowl defining a lower surface of the annular channel 24. A flange 31 carried around the periphery of the outer bowl 15 on a radial support surface 32 cooperates with the annular wall 29 to prevent material entering the area beneath the bowl 15 and confining the material to enter the channel 24. A guide surface 33 formed by an upper surface 34 and a peripheral surface 35 of the housing 28 acts to change the direction of the direction of the material as it exits from the bowl so that it can properly enter the channel 19.

The bowl is driven in rotation by a pulley (not shown) on the shaft 14 which is in turn rotated by a drive motor (also not shown).

The above general description of the centrifugal separator constitutes prior art to the present application as it is shown in my aforementioned U.S. Patents. Further details of the improvements of the present invention will now be described in conjunction with the drawings.

The cover member 19 of the outer bowl 15 is welded to the upper edge of the peripheral wall 18 with the flange portion 32 projecting outwardly therefrom. Similarly the cylindrical ring forming the flange 31 is welded to the outer edge of the flange 32. The inner bowl 10 has at the upper edge of its peripheral wall a flange 36 which is welded to the upper edge of the peripheral wall so as to project outwardly therefrom in a radial plane. The inner bowl is clamped to the outer bowl by insertion of the inner bowl into the outer bowl until the flange 36 sits on the flange 19 following which the flanges are clamped together by suitable fasteners in the form of bolts 37.

As a wear resistant attachment, a cast shaped layer 38 is provided of urethane or similar suitable plastics material which forms an annular surface portion 39 and a depending cylindrical surface portion 40 following the outer surfaces of the portions 32 and 31 of the outer bowl. The layer 38 is attached to the bowl by clamping an inner edge thereof between the flanges 36 and 19 so that the layer 38 is fully attached to the bowl and maintained in contact with the bowl by its shaping and by its firm attachment thereto without the necessity for further fastening devices in the form of screws or adhesive neither of which are satisfactory.

Fluid supplied to the area between the inner and the outer bowl for injection of the fluid into the inner bowl through the openings 22 is fed through the inlet duct 16. As the liquid generally water is obtained from local sources where the separation is taking place, it is often contaminated with fine particles of solids despite attempts to filter the particles from the water. In view of the very high centrifugal action within the annular channel surrounding the inner bowl, these solid particles tend to move toward the outer peripheral surface 18 of the outer bowl rather than to pass through the openings 22 and hence they tend to collect on the outer wall and to build up at that point until the area is fully clogged and the flow of water restricted.

In order to provide an ejection of the collecting solids on the peripheral wall 18 firstly, the peripheral wall is tapered so that it increases in diameter from the base toward the open mouth. Secondly there are provided a plurality of openings 41 drilled through the cover member 19 and through the layer 39. The openings are of sufficient size to allow solids materials collecting on the inner surface of the wall 18 to move to the area between the wall 18 and the cover member 19 under the influence of the centrifugal force and then to be ejected through the openings 41 to join the materials escaping from the open mouth of the bowl for ejection as waste.

The openings 41 are arranged around the periphery of the outer bowl in sufficient numbers and sufficient size to allow the gradual escape of the solids material collecting within the chamber between the inner and outer bowls while not allowing sufficient fluid to escape to interfere with the proper flow of fluid through the openings 22.

In order to prevent or inhibit wear of the parts of the casing surrounding the open mouth of the bowl at a position where the escaping materials are turned to flow in an outward and downward direction, there are provided attached lining materials of a wear resistant plastics. Thus there is provided a first cylindrical member 42 which is formed initially by casting and then attached in place on the inner surface of the outer wall 35 of the housing by screws 43. The screws are arranged at spaced positions around the outer surface of thee wall 35 and pass through suitably drilled holes in the wall 35 to engage into the material of the cast cylinder 42. As the cylinder is cast it is free from seams and joins and is correctly shaped so that it can lie directly on the inner surface of the wall 35 without any excess and without any spacing so that the screws 43 are sufficient to hold the cylindrical liner in place without the necessity for any adhesive or any screws which extend from the inner surface of the liner outwardly. Any such inner screws are of course very rapidly worn and hence become ineffective.

A second sheet of the wear resistant plastics material is formed by casting into an annulus 44 which is attached to the upper surface 34 surrounding the outer periphery thereof and in abutting engagement with the cylindrical liner 42. Similarly the annular liner 44 is held in place simply by screws 45 which again extend from the upper surface of the upper wall 34 into the body of the liner to hold it in place. The liner is cast with sufficient thanks to be substantially rigid to prevent drooping of the liner away from the upper surface.

Turning now to the details of the duct 27 and plug 26, the inner bowl has welded to the outer surface thereof the duct 27 so that it extends outwardly from the periphery as indicated at 50 and from that outward position extends downwardly to a vertically downwardly directed open mouth 51 from which the material in the bowl can be discharged when required. In this embodiment the ribs 21 formed on the inner surface of the bowl are formed by casting from a wear resistant plastics material with the material extending downwardly partly into the duct 27 as indicated at 53. The duct 27 extends through an opening 54 in the base 17 of the outer bowl so that the open mouth 51 is exposed on the underside of the base 17. Within the duct is mounted the plug 26 which is of the type comprising a resiliant body 55 and an end plate 56. The resiliant body is thus pressed into the duct 27 until the end plate 56 engages the open mouth 51 to locate the resiliant body in place. An elongate bar 58 extends through the resiliant body and carries a screw (not shown) which can be rotated by manual grasping of a cross bar 59 with rotation of the screw acting to pull an end plate of the plug remote from the end plate 56 towards the plate 56 so as to compress the resiliant body 55 to more rigidly engage the inner surface of the duct 27. In this way by hand tightening of the screw, the plug can be clamped into place more effectively and this clamping effect can be enhanced by the provision of ribs on the outer surface.

Figure 2:
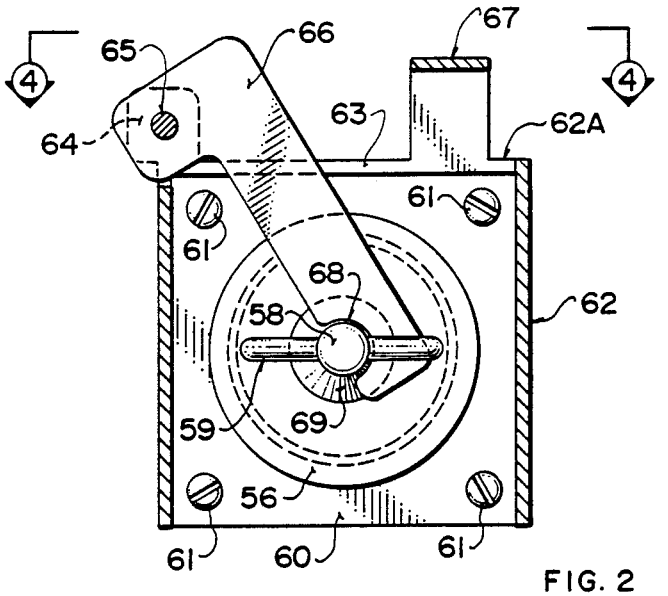
FIG. 2 is an underside view of an enlarged scale of a part of the device of FIG. 1 taken along the lines 2—2 showing the latching arrangement in a latched position.
Figure 3:
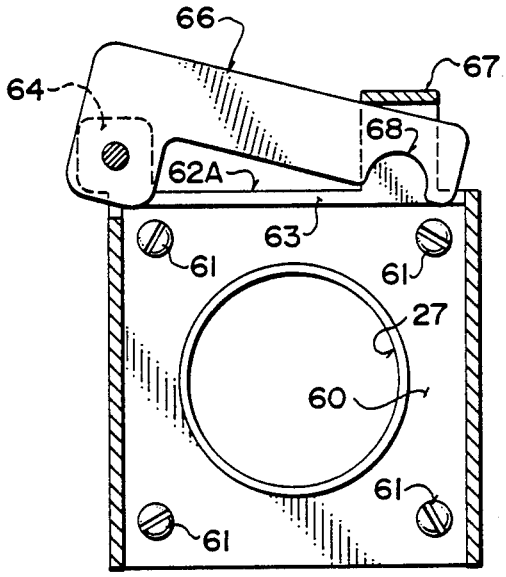
FIG. 3 is a view identical to FIG. 2 showing the latching arrangement in the release position.

However even a plug of this type has been found in many cases to become dislodged due to the very high forces involved in the rapid rotation of the bowl in use. On an underside of the base 17 of the outer bowl therefore there is provided a latching arrangement of a type which is actuated automatically by rotation of the bowl. The latching arrangement comprises a base plate 60 which is square and is bolted to the underside of the base 17 by screws 61 as best shown in FIGS. 2 and 3. Around three sides of the square base 60 is welded an upstanding wall arrangement indicated at 62 which thus projects downwardly to surround on three sides the outlet 51 of the duct and the plug 26. The wall 62 is of sufficient depth merely to extend slightly past the end of the rod 58.

In the wall 62 and particularly the part indicated at 62A thereof which is the wall part facing the open side there is provided a slot 63 which extends across substantially the full width of the wall part 62A at approximately the mid height thereof. Welded to the outer surface of the wall part 62A on either side of the slot is provided a pair of tabs 64 at one end of the slot 63. The tabs carry a vertical pin 65 defining a vertical pivot axis for a pivotal latch member 66. The latch member 66 is formed as a flat plate member which can pivot around the pin 65. The latch member is generally L-shaped in plan view as best shown in FIGS. 2 and 3 with the toe of the L-shape including an opening defining a bearing surface surrounding the pin 65 and carrying the latch member for the pivotal movement. A retaining strap 67 is also welded on the outer surface of the wall part 62A straddling the slot 63.

In the position shown in FIG. 3, the bowl is stationary and the latch member 66 moved to a retracted position in which it passes through the slot 63 and is held just outside the slot by the retaining strap 67. Also shown in FIG. 3 the plug 26 is removed showing the mouth of the duct 27 passing through the plate 60 and through the base 17 (not shown). A suitable sealing arrangement (not shown) is provided between the outer surface of the duct 27 and the plate 60 to prevent the escape of fluid around the outside of the duct 27 from the chamber between the outer bowl on the inner bowl.

Figure 4:
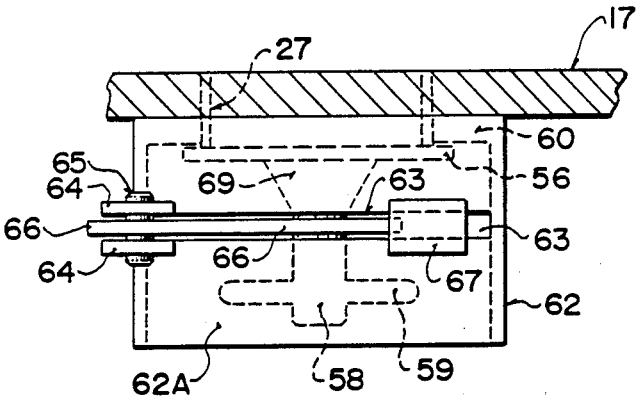
FIG. 4 is a view of the latching arrangement taken along lines 4—4 of FIG. 2.

In the position shown in FIGS. 2 and 4, the plug is in place and the bowl is rotating causing centrifugal action upon the latch member 66 to cause it to rotate into a latched position. In the latched position the member 66 rotates around the pivot pin 65 to take up a position projecting into the interior of the wall 62 to engage the rod 58. For this purpose the latch member includes a circular recess 68 so that it can partially surround the rod 58 in the latched position. In this position an upper side of the plate forming the latch member engages a conical enlargement 69 of the rod 58 so that the rod 58 is prevented by engagement between the conical portion 69 and the recess 68 from moving in a vertically downward direction. Thus the plug is held against any movement which could allow it to escape from the duct 27 while the bowl is rotating caused by the automatic positioning of the latch member in the latched position under the centrifugal force generated by the rotation of the bowl.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. Apparatus for centrifugally separating intermixed materials of different specific gravities comprising a centrifuge bowl having a base and a peripheral wall surrounding an axis passing through the base and generally upstanding from the base to an open mouth, axially spaced inwardly projecting peripherally extending members defined on an inner surface of the peripheral wall so as to provide a peripherally extending recess between each member and the next adjacent member, and a plurality of openings extending through the peripheral wall from an outer surface to the inner surface thereof, the openings being arranged in the recess between each member and the next adjacent member and in spaced relation around the. peripheral wall, means mounting the bowl for rotation about the axis, means for feeding materials into the bowl such that during rotation of the bowl they flow over the peripheral wall for discharge from the open mouth, an outer bowl member surrounding the outer surface of the bowl, means for supplying fluid under pressure between the outer surface of the bowl and the outer bowl member so as to pass through the openings and fluidize the materials in the recesses, said outer bowl member comprising a sleeve member coaxially surrounding said peripheral wall, an outer bowl base and annular cover portion between said sleeve member and said bowl adjacent said open mouth said sleeve member being tapered to define a diameter thereof which increases from one and of the sleeve member adjacent the base to an opposed end of the sleeve member adjacent the open mouth of the bowl, and means defining a plurality of openings in said outerbowl member adjacent said opposed end of the sleeve member to allow escape of solid materials in said fluid.

2. The invention according to claim 1 wherein said openings are defined in said cover portion.

3. The invention according to claim 1 wherein the cover portion includes a first planar portion lying in a plane substantially radial to said bowl axis and a flange portion connected to said planar portion at an outer edge thereof and lying in a cylindrical surface surrounding said bowl axis.

4. The invention according to claim 1 wherein said inner bowl member includes a flange thereof lying in a radial plane of the bowl axis and wherein the outer bowl member includes a cooperating flange thereof lying in a plane radial to the bowl axis and arranged for clamping of the bowl to the outer bowl member by fastening members passing through said flanges and wherein there is provided a liner of a wear resistant material having an annular portion for extending in a radial plane along said flange of said outer bowl member, said wear resistant material being clamped between said flanges of said bowl and said outer bowl member.

5. The invention according to claim 4 wherein said flange of said outer bowl member includes a portion thereof at an outer edge thereof lying in a cylindrical surface surrounding the bowl axis and wherein the layer of wear resistant material includes a cooperating portion shaped to follow said portion of said flange of said outer bowl member.

6. Apparatus for centrifugally separating intermixed materials of different specific gravities comprising a centrifuge bowl having a base and a peripheral wall surrounding an axis passing through the base and generally upstanding from the base to an open mouth, axially spaced inwardly projecting peripherally extending members defined on an inner surface of the peripheral wall so as to provide a peripherally extending recess between each member and the next adjacent member, and a plurality of openings extending through the peripheral wall from an outer surface to the inner surface thereof, the openings being arranged in the recess between each member and the next adjacent member and in spaced relation around the peripheral wall, means mounting the bowl for rotation about the axis, means for feeding materials into the bowl such that during rotation of the bowl they flow over the peripheral wall for discharge from the open mouth, means for applying fluid to the outer surface of the bowl so as to pass through the openings and fluidize the materials in the recesses, a discharge duct mounted in said bowl through the base thereof, a removable plug member for closing the duct during rotation of the bowl, and latch means movable from a release position in which the plug member can be removed to a latching position for latching the plug member in a position thereof closing said duct, the latch means being movable to said latching position in response to centrifugal force generated by rotation of the bowl.

7. The invention according to claim 6 wherein the latch means comprises a support member mounted on an underside of the base of the bowl and a latch portion mounted on the support member for pivotal movement relative thereto about an axis parallel to said bowl axis.

8. The invention according to claim 7 wherein the support member comprises a wall member extending from said base generally at right angles thereto and at least partly surrounding said duct, said wall member having a slot therein, said latch member comprising a substantially planar body pivotal in the plane of the slot so as to project, in said release position, to a position extending outside said wall member through said slot.

9. Apparatus for centrifugally separating intermixed materials of different specific gravities comprising a centrifuge bowl having a base and a peripheral wall surrounding an axis passing through the base and generally upstanding from the base to an open mouth, axially spaced inwardly projecting peripherally extending members defined on an inner surface of the peripheral wall so as to provide a peripherally extending recess between each member and the next adjacent member, means mounting the bowl for rotation about the axis, means for feeding materials into the bowl such that during rotation of the bowl they flow over the peripheral wall for discharge from the open mouth, a housing surrounding the open mouth for collecting and confining the material discharged therefrom, said housing defining an annular channel having an upper wall facing said open mouth and a peripheral wall surrounding said bowl which directs the material to an outlet duct and a wear resistant liner arrangement for said channel formed from a wear resistant plastics material, said liner arrangement including a cast annular ring attached to said upper wall at said peripheral wall and a cast cylindrical sleeve attached to an inner surface of said peripheral wall at said upper wall.

10. The invention according to claim 9 wherein said ring and said sleeve are attached by screws passing through said upper wall and said peripheral wall respectively, said screws engaging into the material thereof.

11. The invention according to claim 9 wherein said bowl includes a flange having a first part lying in a radial plane surrounding the bowl at the open mouth thereof and a second part lying in a cylindrical surface at the outer edge of the first part extending axially of the bowl from said open mouth towards said base and wherein the flange has a covering formed by a cast liner member.

12. The invention according to claim 11 wherein said bowl comprises an inner bowl and an outer bowl member surrounding the inner bowl, said inner bowl being clamped to said outer bowl member by flanges thereof lying in a radial plane surrounding the bowl axis, said cast liner member being clamped between said flanges.

* * * * *